US008919589B2

(12) United States Patent
Hill

(10) Patent No.: US 8,919,589 B2
(45) Date of Patent: Dec. 30, 2014

(54) BULK BIN AND BAG

(75) Inventor: Gary Hill, North Geelong (AU)

(73) Assignee: Materials Handling Systems Australia Pty Ltd, North Geelong Victoria (AU)

( * ) Notice: Subject to any disclaimer, the term of this patent is extended or adjusted under 35 U.S.C. 154(b) by 0 days.

(21) Appl. No.: 13/820,427

(22) PCT Filed: Aug. 25, 2011

(86) PCT No.: PCT/AU2011/001089

§ 371 (c)(1),
(2), (4) Date: May 20, 2013

(87) PCT Pub. No.: WO2012/027778

PCT Pub. Date: Mar. 8, 2012

(65) Prior Publication Data

US 2013/0228574 A1 Sep. 5, 2013

(30) Foreign Application Priority Data

Sep. 2, 2010 (AU) ..... 2010903949
Jan. 18, 2011 (AU) ..... 2011900160

(51) Int. Cl.

| | |
|---|---|
| ***B65D 33/02*** | (2006.01) |
| ***B65D 19/12*** | (2006.01) |
| ***B65D 90/62*** | (2006.01) |
| ***B65D 77/06*** | (2006.01) |
| ***B65D 88/52*** | (2006.01) |

(52) U.S. Cl.

CPC ..... *B65D 33/02* (2013.01); *B65D 19/12* (2013.01); *B65D 2519/00024* (2013.01);

(Continued)

(58) Field of Classification Search

CPC ..... B65D 33/02; B65D 88/522; B65D 88/52; B65D 90/623; B65D 90/62; B65D 21/0215; B65D 21/0209; B65D 21/045; B65D 21/043; B65D 21/04; B65D 2519/00273

USPC ..... 220/9.3, 9.2, 9.1, 6, 4.27, 4.26, 826, 220/810, 380; 206/512, 509, 508, 507, 505, 206/503, 600

See application file for complete search history.

(56) References Cited

U.S. PATENT DOCUMENTS 2,869,750 A * 1/1959 Doerr et al. ..... 220/4.28
3,797,691 A * 3/1974 Williams, Jr. ..... 220/1.5

FOREIGN PATENT DOCUMENTS

GB 202857 A * 9/1922 ..... B65D 33/02
WO 9731832 A1 9/1997

(Continued)

*Primary Examiner* — Robert J Hicks

(74) *Attorney, Agent, or Firm* — Blank Rome LLP

(57) ABSTRACT

The present invention relates to a bulk bin for use with a liner bag. The bulk bin includes a sub-structure that is configured to receive forktines of lifting machinery for moving the bulk bin and a collapsible upper assembly that can support a bag with an entrance thereof in an upwardly facing orientation for filling. The bulk bin also includes at least one self supporting stiffened lid, and suitably a pair of lids. The lids may be pivoted from a closed position to an open position by orienting the bin into an inclined position in which the lids can open under gravity.

29 Claims, 11 Drawing Sheets

(52) U.S. Cl.
CPC ..... *B65D 2519/00273* (2013.01); *B65D 2519/0096* (2013.01); *B65D 2519/00208* (2013.01); *B65D 2519/00293* (2013.01); *B65D 2519/00905* (2013.01); *B65D 2519/00731* (2013.01); *B65D 2519/00094* (2013.01); *B65D 90/623* (2013.01); *B65D 2519/00233* (2013.01); *B65D 77/061* (2013.01); *B65D 2519/00243* (2013.01); *B65D 2519/00562* (2013.01); *B65D 2519/00298* (2013.01); *B65D 2519/00323* (2013.01); *B65D 88/522* (2013.01); *B65D 2519/00069* (2013.01); *B65D 2519/0097* (2013.01); *B65D 2519/00059* (2013.01); *B65D 2519/00104* (2013.01); *B65D 2519/00199* (2013.01); *B65D 2519/00034* (2013.01); *B65D 2519/00373* (2013.01); *B65D 2519/00691* (2013.01); *B65D 2519/00333* (2013.01)
USPC ..... 220/9.3; 220/9.2; 220/6

(56) References Cited

FOREIGN PATENT DOCUMENTS

| | | | |
|---|---|---|---|
| WO | 0156898 | A1 | 8/2001 |
| WO | 03024815 | A1 | 3/2003 |
| WO | 2007053997 | A1 | 5/2007 |
| ZA | 9405779 | A | 2/1996 |

* cited by examiner

BULK BIN AND BAG

CROSS-REFERENCE TO RELATED APPLICATIONS

The present application is a National Phase of PCT/AU2011/001089, filed Aug. 25, 2011, which claims the benefit of Australian Application No. 2010903949, filed Sept. 10, 2010 and Australian Application No. 2011900160, filed Jan. 18, 2011, the entire disclosures of which are incorporated herein by reference.

FIELD OF THE PRESENT INVENTION

The present invention relates to a bulk bin for use with a liner bag. The bulk bin may be transportable from one location to another.

BACKGROUND OF THE PRESENT INVENTION

Bulk bins typically have a capacity on the range of 0.5 to 3 cubic meters and can be used for carrying a large range of different materials such as agricultural produce, mining materials and feedstock of manufacturing processes. There are at present a variety of different bulk bins on the market and one type of bulk bin that has gained wide acceptance in a number of different applications, particularly in the food related processing industries is a knock-down bulk bin. A feature of the knock-down bin is that when in an assembled orientation, the bin is used to transport material from a supplier to a consumer, and once the bin has been emptied by the consumer, the bin can be collapsed and transported back to the supplier in a space saving manner for re-assembly and re-filling by the supplier. Knock-down bulk bins are generally of significant monetary value and may or may not include a bag liner that is discarded after each use or on an as needs basis.

A number of the knock-down bulk bins currently available are assembled and collapsed manually. The manual assembly of the bulk bin is both time consuming and labour dependent, which ultimately increases operating costs when using such bins.

It is an object of the present invention to provide an alternative bulk bin.

SUMMARY OF THE PRESENT INVENTION

The present invention relates to a bulk bin for use with a liner bag, the bulk bin including:

- a sub-structure that is configured to receive forktines of lifting machinery for moving the bulk bin;
- a collapsible upper assembly that is supported on the sub-structure, wherein the upper assembly is able to support a bag with an entrance thereof in an upwardly facing orientation for filling, and the upper assembly can be moved between, i) a collapsed orientation to facilitate transportation of the bulk bin in a space saving manner, and ii) an erected orientation for using the bin; and
- at least one lid that is moveable to open and close the entrance to the bag, and the lid has a stiffness that allows the lid to be seated against the upper assembly when closed and span self supportingly over the entrance of the bag.

The lid may be moved to open and close the entrance of the liner bag by any suitable action including pivoting, sliding or rolling movement of the lid. For example, the lid may be a rolling lid, a sliding lid, or a lid that concertinas in two or more sections.

The lid may be configured so that orienting the bin to selected positions can cause the lid to open under gravity. For example, when the bin is tilted into an inclined position, the lid can open under gravity. For instance, this may occur when the slid is a sliding or rolling lid.

The lid may be configured so that orienting the bin into a position in which the lid faces downwardly can cause the lid to open under gravity. The bin may be facing downwardly when the lid, while in a closed position, is oriented to face below a horizontal plane. In another situation, the lid can open when the bin is inverted. One of the reasons for inverting the bin is to provide a level of assurance the bin is completely empty. This may be important when the bin is being loaded with different items on each cycle.

Suitably, the lids completely uncover the entrance of the bag when the lids of the bin are opened. Thereby, allowing items to be emptied without obstruction when the lid is opened, for example, by inverting the bin.

The lid may also be moved manually by hand or by an actuator. The actuator may form part of the bulk bin, or the actuator may be independent of the bulk bin. The actuator may be any form of actuator including mechanically driven actuators such as levers and rams, electrically driven actuators, hydraulically driven actuators and pneumatically driven actuators or any combination thereof.

The lid may be pivotally mounted and is able to be pivoted through suitably at least 90 degrees, suitably at least 180 degrees to open and close the entrance of the liner bag.

The bin may include two lids that are mounted to the upper assembly and have side edges that overlap when in the closed position. Suitably, the lids have oppositely disposed pivot mountings and the lids pivot inwardly toward each other so that outer side edges of the lids overlap when in the closed position.

The bin may include a pair of lids that together cover the entrance of the bulk bag. Each lid may extend across half of the width of the bin and are opened by being pivoted into an open position in which the lids are located adjacent to outer sides of the bulk bin. For instance, the lids can be pivoted from a horizontal orientation into a vertical orientation through approximately 270°. An advantage of this aspect of the bin is that multiple bins are able to be placed side-by-side at a spacing of approximately half the width of the bins and the lids of adjacent bins can be opened and closed while side-by-side. This aspect can be beneficial when the bins are placed in bays for emptying and filling.

The lid(s) may be pivotally mounted to the upper assembly by any hinge mechanism such as a pin mounted to the bin that is received by a bore formation of the lid(s). Alternatively, the lid(s) may be pivotally mounted to the upper assembly via a flexible medium, such as a fabric or polymeric medium. The flexible medium may form part of the liner bag and be integrally connected thereto or be independent of the liner bag.

In an embodiment, an engagement surface attached to the lid(s) pivots about the pivot axis of the lid(s), and the engagement surface faces upwardly when the lid(s) are located in a closed position such that when the bins are stacked one on top of the other, the engagement surface of a lower bin can be engaged by the upper bin so as to hold one or more of the lid(s) of the lower bin in a closed position. Suitably the bins include said hinge mechanism and the lid(s) are attached thereto, and the hinge mechanism defines the pivot axis and includes the engagement surface which is disposed above a plan of the lid(s) when in a closed position.

The engagement surface suitably aligns with a support surface of the upper assembly when the lid is in a closed position, and the support surface can support the weight of a bin stacked on top thereof and allow the upper bin to contact the engagement surface of the lower bin. In other words, the engagement surface does not support the entire weight of the upper bin yet the weight of the upper bin prevents the lid from being opened.

The bulk bin may include a retainer that releasably secures the lid(s) in either the opened position and/or the closed position. For example, the retainer may be a latch mechanism or co-operating hook and loop fasteners. In another example, the retainer may be co-operating magnets. For instance, co-operating magnets may be mounted to the lid(s) and operably attract when the lid(s) are closed to secure the lid(s) closed. In the alternative or additionally, co-operating magnets may be mounted to the lid(s) and to parts of the upper assembly so that the magnets of the lid(s) are operatively attracted to the magnets of the upper assembly when the lid(s) is in the opened or closed position.

The lid(s) may have i) an outer peripheral portion that can be seated on an abutment surface of the upper assembly and ii) an inner protruding portion that protrudes in a direction lateral from the outer peripheral portion so that when the door is located in a closed position the inner protruding provides a barrier to contaminants (such as dust) passing between the outer peripheral portion and the abutment surface. In other words, when the door is in a closed position, the inwardly protruding portion forms a barrier that further inhibits the ingress of dust into the liner bag that has past between the outer peripheral portion and the abutment surface of the upper assembly.

The inner protruding portion may be orthogonal to the peripheral portion. For example, when the lid is closed, the peripheral portion may be oriented substantially horizontally, and the inner protruding portion may be oriented substantially vertically when the door is viewed in a closed position.

A deformable medium may be located between the lid(s) and the upper assembly to hinder the ingress of contaminants into the bag liner. The deformable medium may be a lip or rim that extends about the upper assembly and, may for example, be a rubberized or polymeric material. Typically, the deformable medium is a skirt about the entrance to the liner bag and, suitably, the skirt is in the upper end of the bag.

The sub-structure may include forktine cavities for receiving the forktines of a forklift truck, and the cavities having an upper partition to prevent the bag liner entering into the cavities. An advantage of the feature is that bag liner is prevented from becoming jammed between the forktines and the sub-structure which could tear the bag liner. The partition may be in the form of a deck that defines an upper face of the sub-structure. The deck provides a surface that extends across the width of the sub-structure. An underside of the deck may be contacted by forktines when being move from location to location.

The sub-structure may include lower supports and the upper assembly includes posts that fit the lower supports, and either one or both of the lower supports and the posts have tapering surfaces that guide alignment for inter-fitting of the lower supports and the posts. Suitably, the posts of the upper assembly taper inwardly toward the lower most end of the post. Suitably, the lower supports of the sub-structure taper outwardly toward an upper most end of the lower support and receive the posts of the upper assembly.

The upper assembly may have collapsible posts. For example, the post may include pivotally connected linkage members that interconnect to form a load bearing post and the linkage members fold when collapsed.

The sub-structure may include:

an upper quadrangular frame on which the lower supports are mounted;

a lower quadrangular frame for sitting on the ground;

four corner sub-posts that interconnect the upper and lower quadrangular frames; and intermediate sub-supports disposed between the corner sub-posts and interconnecting the upper and lower quadrangular frames.

Two of the intermediate sub-posts are spaced apart in the range of 600 to 800 mm along the quadrangular frames. Suitably, the inner sub-posts are located in the range of 100 to 200 mm inward of the pairs of corner posts of the upper assembly.

The bulk bin may also be characterised as including a liner bag having a flexible bottom wall a flexible side wall that defines the upper entrance of the bag and the side wall folds when the upper assembly is moved between erect and collapsed orientations.

The upper assembly of the bin may include a top frame, such as a quadrangular frame, and the entrance of the bag may be attached to the top frame. Suitably, a side wall of the bag, defining the entrance to the bag, is located on an inside of inwardly facing surfaces of the top frame and the entrance of the bag is equal to, or smaller than, the perimeter of the top frame. The bag may be attached to the inwardly surfaces of the top frame, however suitably, the bag can be folded outwardly and attached to either upper and/or outwardly facing surfaces of the top frame.

The bag may have a constant peripheral measurement or a reducing peripheral measurement in a direction away from the entrance. In other words, the bag may have a constant cross-section or a reducing cross-section in a direction moving away from the entrance. The peripheral measurement may be the length of the perimeter extending about the side wall of the bag. Suitably, the constant peripheral measurement is equal to, or less than, the perimeter of the entrance of the bag.

The configuration of the entrance the bag, the side wall of the bag, and the top frame, is such that the side wall of the bag provide a continuous and unobstructed surface leading to the entrance of the bag so that items can be emptied from the bag.

The entrance of the bag may a lip formation for engaging an inside surface of the lid, but suitably, the bag is without a lip.

The side wall of the liner bag is elasticised about at least part of the perimeter of the side wall of the liner bag (or about the circumference of the of the liner bag), and suitably entirely around the perimeter of the liner bag so as to retract the side wall inwardly when unload or when the upper assembly is collapsed. Although the elasticity of the side wall may be incorporated in the structure of the side wall, suitably the liner bag includes an elastic element about either the perimeter of the liner bag that is located at a height that is at least half the height of the side wall, and ideally approximately two thirds of the height of the side wall. Suitably the elastic element also extends about the bottom wall of the liner bag.

In an embodiment, the side wall of the bag liner is elasticised over at least part of its height and/or elasticised over at least part of the bottom wall of the liner bag so as to draw lower sections of the bag liner inwardly and/or upwardly. Suitably, the liner bag includes an elastic element located on opposite sides and over at least half the height of the liner bag and even more suitably across the bottom of the liner bag.

The present invention also relates to a flexible bulk bag having a pre-formed shape, which when being filled, is supported by the framework described above and can hold an upper part of the bulk in a pre-formed shape of the bulk bag for filling, the bulk bag including:

a bottom wall; and a side wall extending upwardly from the bottom wall, the side wall including an openable panel for emptying material from the bag, wherein the bottom wall and/or side wall is elastic so as to retract the bottom wall and/or side wall inwardly.

The bulk bag may be sized so that when loaded with material, the bag is confined within the corner post of the upper assembly of the framework.

The side wall may include an openable panel located adjacent to the bottom wall for discharging material from the liner bag. Suitably, the openable panel of the side wall is approximately is in the range of 0.02 to 0.5 $m^2$ in area and even more suitably in the range of 0.1 to 0.3 $m^2$.

The bulk bag may have a capacity in the range of 0.5 to 1.5 cubic meters and suitably approximately 1 cubic meter.

BRIEF DESCRIPTION OF THE FIGURES

The present invention will now be described with reference to the accompanying Figures, of which.

DETAILED DESCRIPTION

Figure 1:
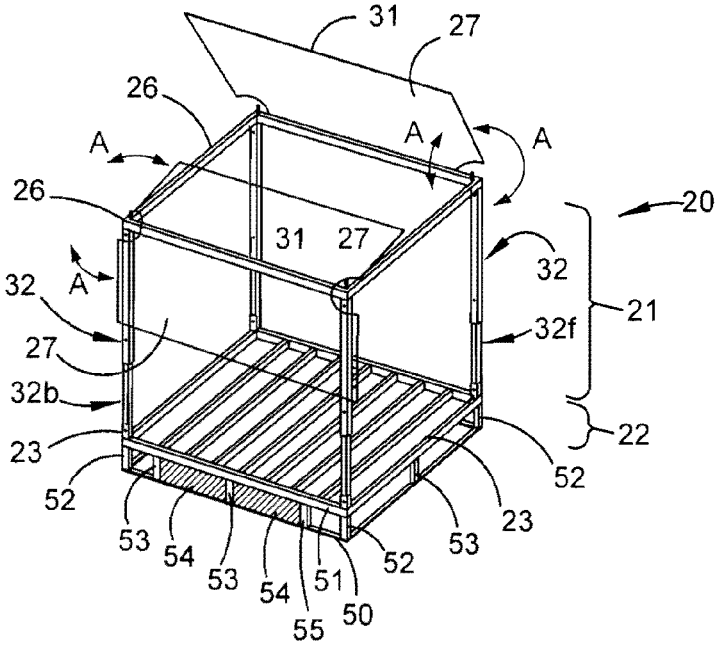
FIG. 1 is a schematic perspective view of an assembled bulk bin including two lids that can be pivoted between opened and closed positions, wherein the bulk bin shown in FIG. 1 is without a bag liner.
Figure 2:
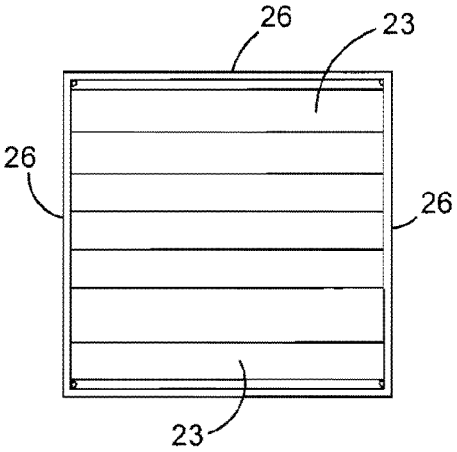
FIG. 2 is a top view of the bulk bin that is shown in FIG. 1 in which the lid has been removed.

A preferred embodiment of a bulk bin and a flexible liner bag will now be described with reference to the Figures. The Figures contain reference numerals that identify particular features. However, in the interest of maintaining clarity of the Figures, not all of the reference numerals have been included in each of the Figures.

With reference to the Figures, the bulk bin 20 includes a collapsible upper assembly 21 having an lid assembly 19 that can be pivoted to open and closed a bag liner 40, a sub-structure 22 on which the upper assembly 21 is mounted and having openings for receiving forktines 24, and a deck 23 supported by the sub-structure. When in use, a bottom surface of the bulk bag 40 may contact the upper face of the deck 23 and when being moved, the underside of the deck 23 may be contacted by forktines 24 of a forklift truck. An embodiment of a bulk bag 40 shown in FIGS. 8*a* and 8*b* can be fitted to the bulk bin 20 with an upwardly facing entrance and the lid assembly 19 can be pivoted to open and close the entrance to the bag 40.

The upper assembly 21 includes a rectangular (in this case, square) top frame 26 and four corner posts 32 that interconnect the top frame 26 to the sub-structure 22. As can be seen in FIG. 1, the lid assembly includes two lids 27 that are pivotally mounted to the top frame 26 so as to pivot over approximately 270 degrees in the direction of the arrows A. When the lids 27 are located in a horizontal orientation, the lids 27 close the entrance to the bag liner. The lids 27 can be pivoted outwardly and downwardly so as to be located at the sides of the bulk bin 20, and suitably to the left and right sides of the bulk bin 20 that do not receive forktines. Suitably, the sub-structure 22 is configured to receive forktines either from the front or rear of the sub-structure.

An advantage of the lids 27 pivoting between opened and closed positions is that the bulk bin 20 can be readily opened and closed while being carried by a forklift or other lifting mechanism. Moreover, when the bulk bin is oriented into an inclined position, and preferably when the lids 27 face downwardly, the lids 27 can pivot open under gravity.

An additional advantage is that multiple bulk bins 20 can be placed side-by-side in loading and filling bays when the lids 27 are fully opened in the downward orientation and the spacing between the bins 20 may be any spacing greater than half the width of the bin, or in other words, at least the width of the lids 27 so that the lids can be closed without moving the bulk bins 20.

Figure 6:
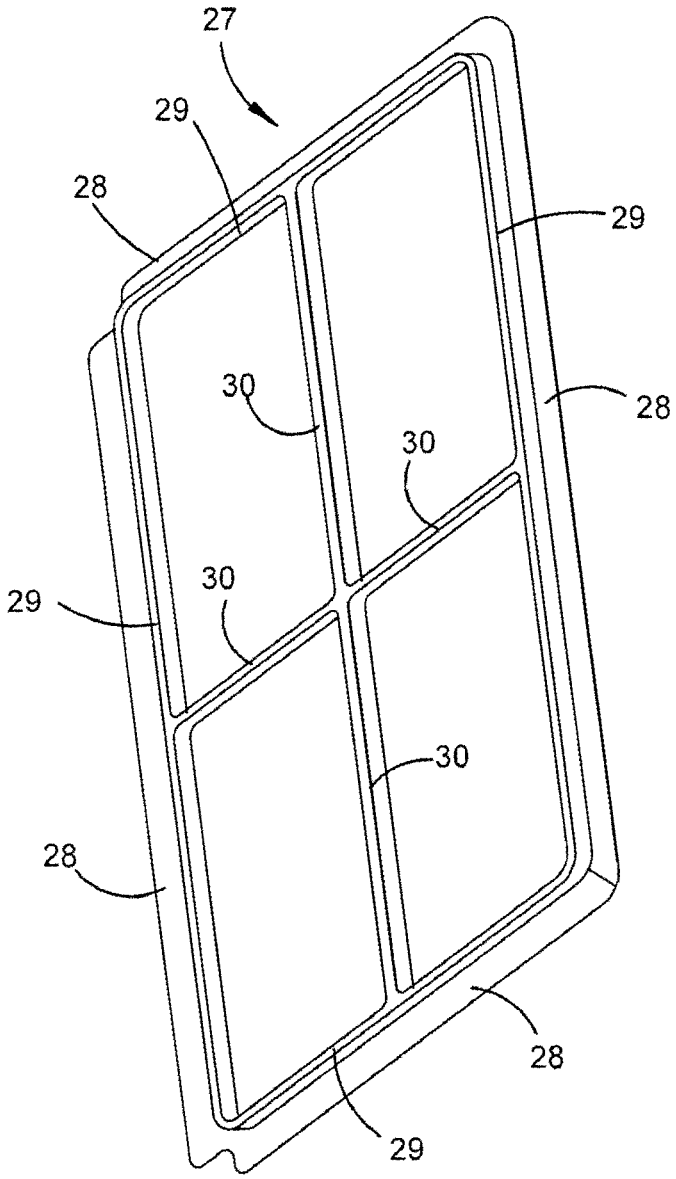
FIG. 6 is a schematic illustration of an underneath view of one of the lids of the bulk bin of FIG. 1.

FIG. 6 is an underneath view of one of the lids 27. As can be seen, the lids 27 include an outer peripheral portion 28 having a flat profile and an inner protruding flange 29 adjacent to the peripheral portion 28. Reinforcing flanges 30 also criss-cross the width and length of the lid 27. When the lids 27 are fully closed, the peripheral portion 28 rests against an upper abutment surface of the top frame 26 and the protruding flange 29 extends downwardly and inside the upper surface of the top frame 26 so as to provide a barrier to debris and other contaminants entering into the bag liner 40. When closed, outer edges 31 of the lids 27 opposite to the hinged mounting overlap.

Suitably each lid 27 has sufficient stiffness to allow the lid 27 to span between opposite sides of the top frame 26 without extraneous tensioning devices, internal supports or external supports. In other words, the lid 27 can span between opposite sides of the top frame 26 in a self supporting manner. The stiffness of the lids 27 also enables the lids 27 to be manoeuvred between open and closed position by automated mechanisms or by orienting the bin into selected positions, for example, tilting the bin 20 so that the lids 27 face downward. The lids 27 may be made of any material including metallic materials, and non-metallic materials including moulded polymeric materials.

Figure 7:
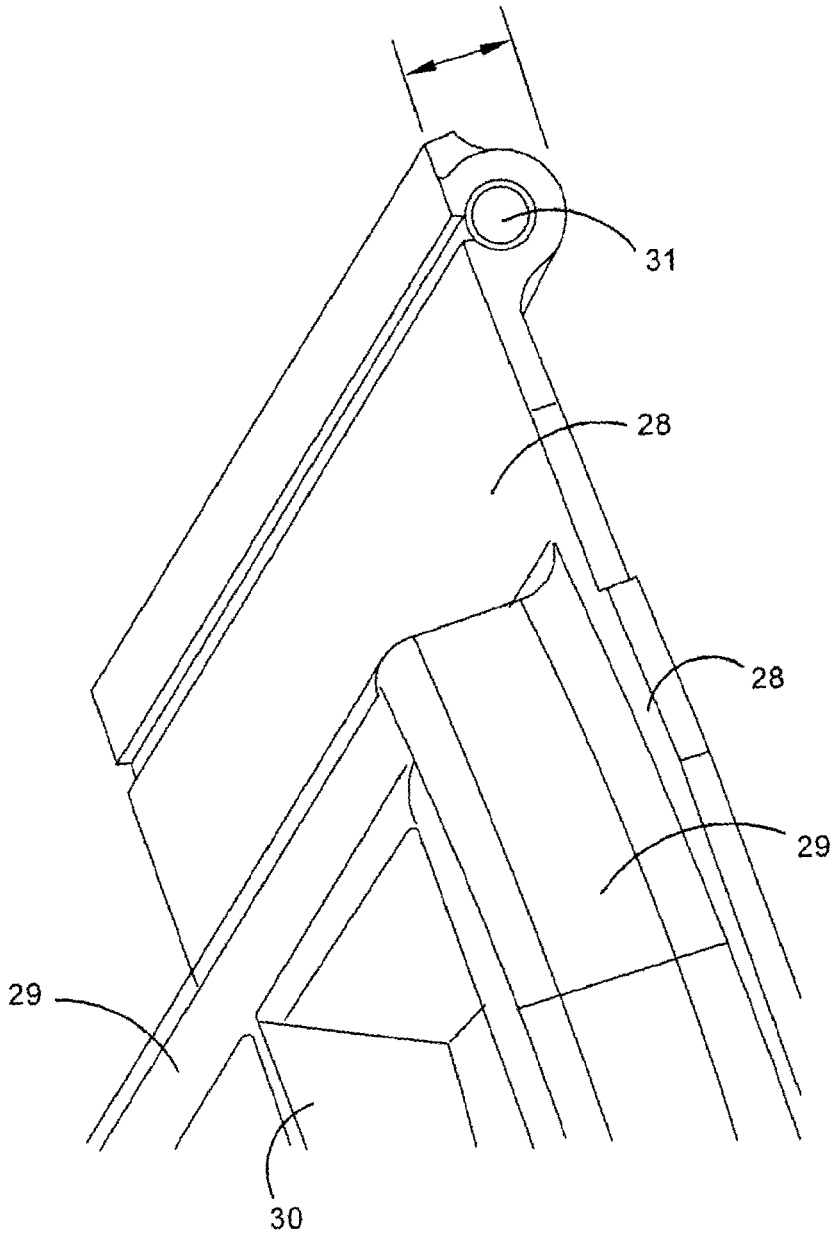
FIG. 7 is a close up view of a pivot mounting of the lids shown in FIG. 6.

FIG. 7 is a close up view of a hinge mounting portion of one of the lids 27. As can be seen, the hinge mounting includes a bore formation 31 integrally connected to the outer peripheral portion 28. Although not shown in detail in the drawings, the posts 32 at the corners of the bulk bin 20 extend above the upper abutment surface of the top frame 26 and mounting pins are mounted to the corner posts 32 and extend through the bore formation 31 for pivotally mounting the lids 27. An another hinge assembly 73 is described below with reference to FIGS. 12 to 14.

As can be seen in FIGS. 1, 2, 5 and 9, the deck 23 extends across the sub-structure 22 so as to form a partition between a bag liner 40 fitted to the bulk bin 20 and forktines 24 received by the sub-structure 22. The partition helps to prevent pinching and tearing of the bag liner 40 during handling of the bulk bin 20.

Although not shown in detail on the Figures, the bulk bin 20 may also include a latching device for releasably securing the lids 27 in a closed position and an opened position. The latching device may include mechanical devices or co-operating pairs of magnets for securing the lids 27 in an opened or closed position. For example in one construction, magnets may be attached to the lids 27 and co-operating magnets to the top frame of the upper assembly for magnetically securing the lids 27 in a closed position. A co-operating magnet may also be mounted to a part of the upper assembly between the top frame and the sub-structure so as to magnetically secure the lids 27 when the lids 27 are fully opened.

Figure 9:
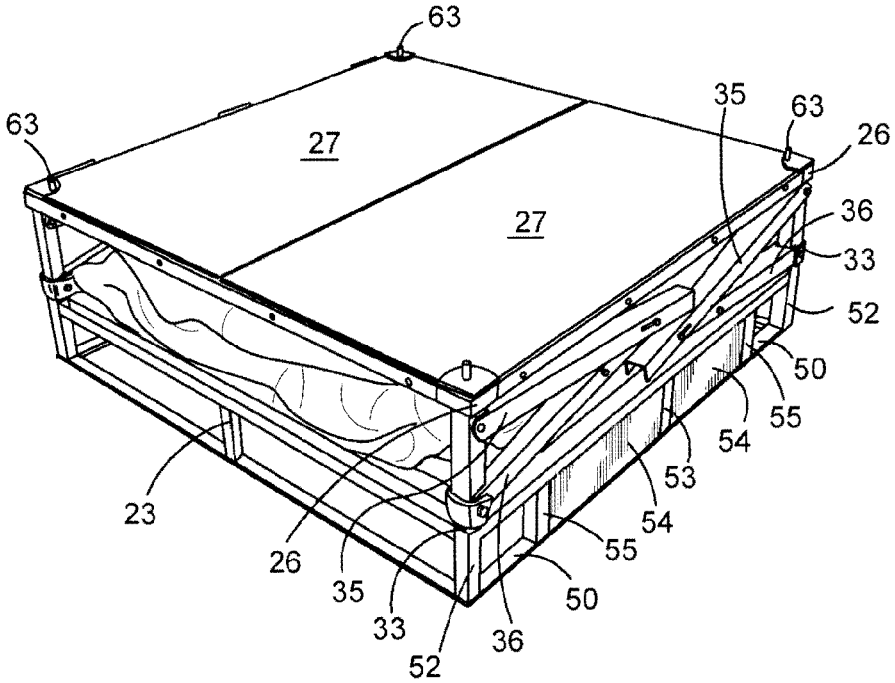
FIG. 9 is a left hand perspective view of the bulk bin of FIG. 1 when in a collapsed orientation.

The four corner posts 32 of the upper assembly 21 comprise the following components: four lower corner posts 33 extending upwardly from the sub-structure 22; four upper corner posts 34 that extend downwardly from the top frame 26 and two interconnected linkage members 35 and 36 that are pivoted to the upper and lower corner posts 33 and 34 respectively. The linkage members 35 and 36 fold inwardly to lower the top frame 26 toward the sub-structure 22 as shown in FIG. 9. Although not shown in the Figures, suitably the lower corner posts 33 widen in a direction toward the ends thereof and a lower end of the lower number 36 tapers inwardly to facilitate automated assembly of the member 36 into the lower corner posts 33.

The top frame 26 also includes cleats 63 projecting upwardly therefrom that are received by co-operating openings (not show in the Figures) in a bottom face of the base frame 22 when bulk bins 20 are stacked one on top of the other.

An embodiment of a bulk bag 40 that can be used with the bulk bin 20 is shown in FIGS. 8*a*, 8*b*, 10 and 11. As can be seen, the bag 40 includes a base panel 43 and four side wall panels 44 extending upward from the base panel 43. The base panel 43 and side wall panels 44 can be stitched and/or glued together using suitable attachment techniques. Any seams formed between the base panel 43 and the side wall panels 44 may be located to the outside of the bag 40 to minimise interference with items loaded therein. An annular portion 41 of material extends from an upper portion of the bulk bag 40 and a skirt 42 of the bag material extends from portion 41. The skirt 27 further prevents dust from entering the bag liner.

Figure 8A:
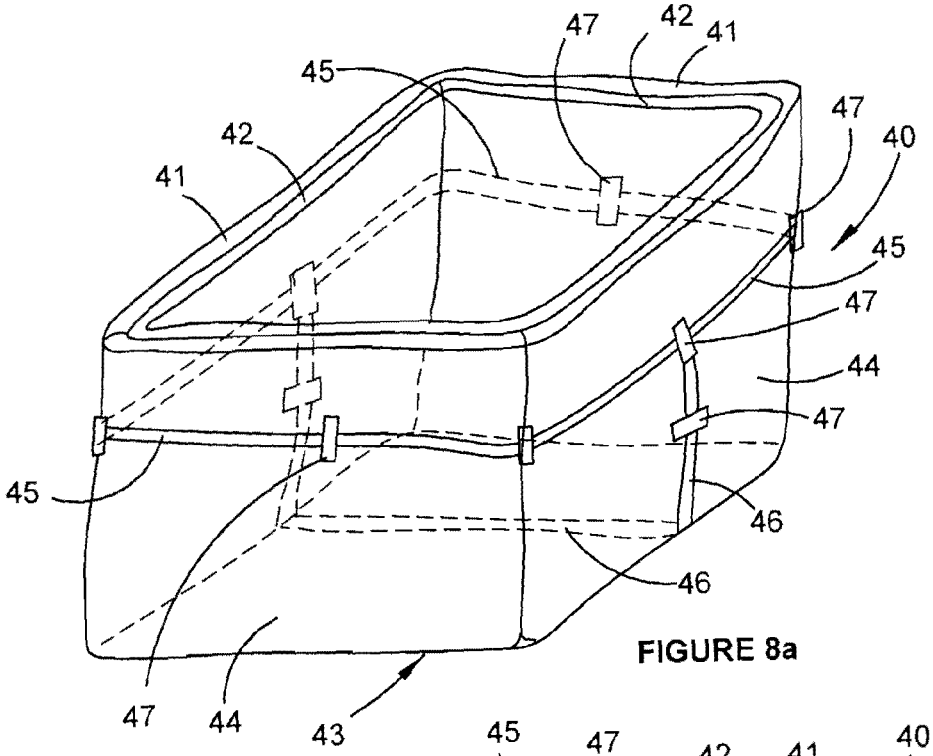
FIG. 8*a* is a perspective view of a bag liner adapted for the bulk bin shown in FIGS. 1 to 5 having elasticised portions, wherein the elasticised portions are extended in tension as if the bag was filled with material.
Figure 8B:
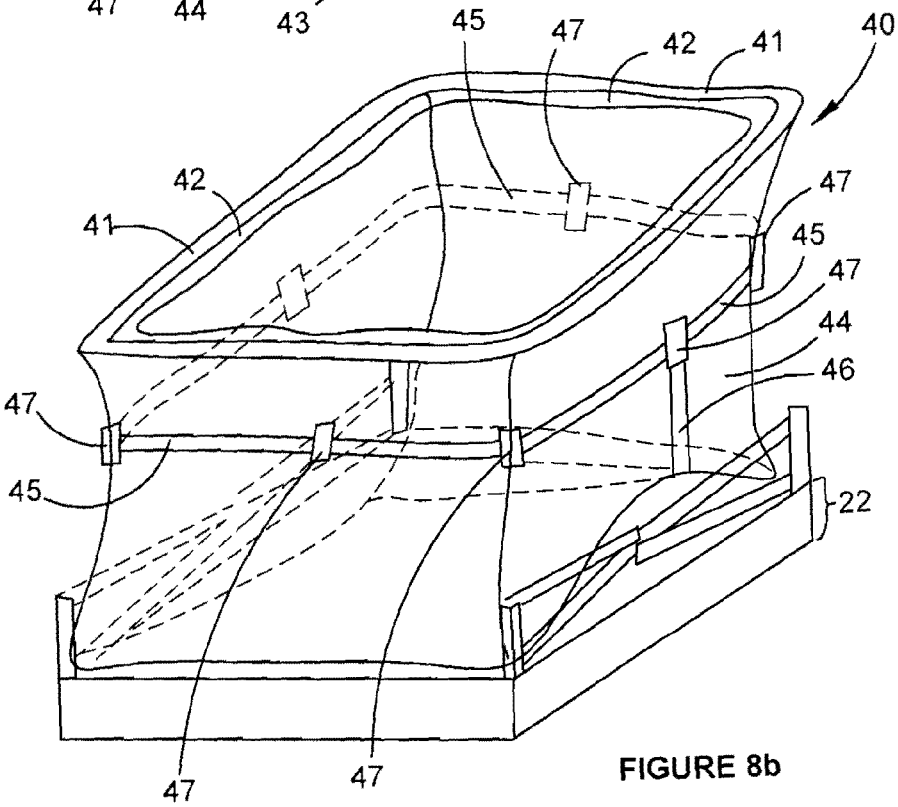
FIG. 8*b* is a perspective view of the bag liner of FIG. 8*a* in which the elasticised portions are in a retracted neutral state as if empty of material.

A first elastic strap 45 extends about the perimeter of the bulk bag 40 at a height of approximately two thirds of the height of the side walls 44. A second elastic strap 46 is configured in a U-shape and extends down the side walls 44 and underneath the base panel 43 of the bag 40. FIG. 8*a* illustrates the bag liner 40 filled, which in turn places the elastic straps 45, 46 in tension. FIG. 8*b* illustrates the bag liner 40 emptied, which in turn locates the first and second elastic straps 45 and 46 in a relaxed state. In particular, when the bag 40 is emptied, the first elastic strap 45 pulls the side walls of the bag liner 40 inwardly and the second strap 46 pulls the base panel 43 upwardly and inwardly approximately halfway along the bag 40.

As can be seen from FIG. 8*b*, the second strap 46 is located on the side wall of the bag 40 that is adjacent to the collapsed linkage members 35, 36 of the upper assembly 21. The first and second straps 45 and 46 reduce the chance of the bag liner 40 becoming caught between the linkage members 45 and 46 during collapsing of the bulk bin 20. FIG. 9 illustrates the linkage members 45 and 46 in a collapsed orientation.

The first and second straps 45 and 46 are held in position by tabs 47 sewn to the outside of the bag 40 and form loops through which the straps 45 and 46 can slide. As an alternative embodiment, the side walls 44 and base 43 of the bag liner 40 may include elastic threads or strapping that is woven, bonded or stitched to the side walls 44 and base 43 of the bag liner 40.

Extending around the perimeter of the top frame 26 are lengths of right angle bar. The right angle bar is held in the position using bolts, screws or any other suitable fasteners and the bag 40 is held in place to the upper assembly 26 by portion 41 being sandwiched between the right angle bar and the upper and/or outer faces of the top frame 26.

Figure 11:
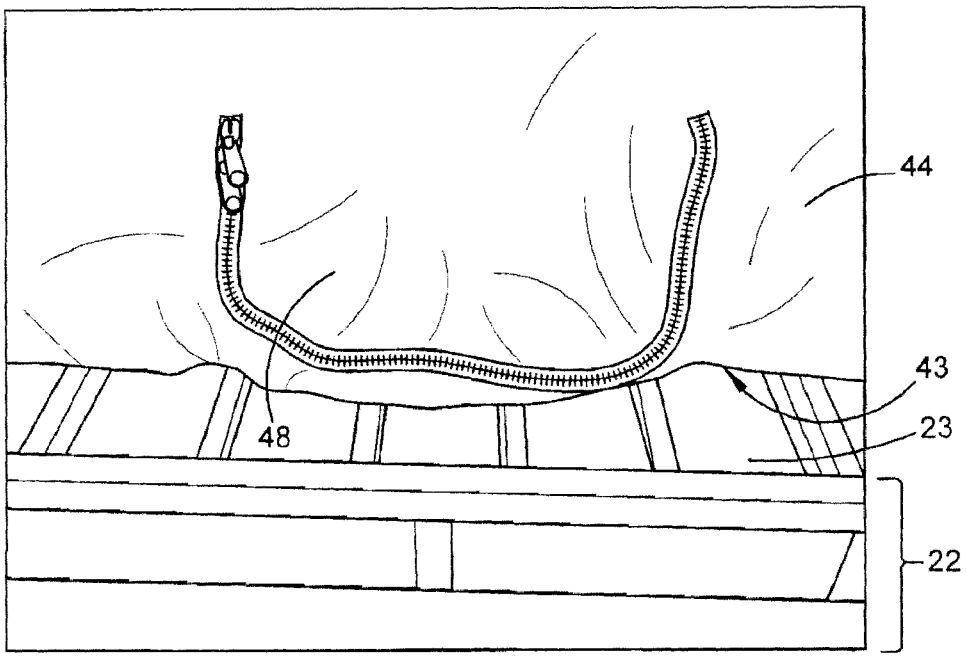
FIG. 11 is a detailed view of an openable panel in a lower portion of a side wall of the bulk bag in a closed position.

The bag 40 can be emptied by tipping the bulk bin 20 into a selected position such that the lids 27 swing into an open position under gravity. However, as shown in FIG. 11 it is preferred that one of the side walls 44 has at least one openable panel 48, suitably located adjacent to the base panel 43 of the flexible bag 40 through which material can be discharged. Suitably, the openable panel 48 which is in the form of tongue cut into the side wall of the bag and includes a zipper which is operable to close and open the tongue.

The flexible bag 40 may be made of any suitable material including polymeric materials and in particular polypropylene. The inside and/or outside of the bag may be coating with a softer layer for product protection. The bulk bag may also be liquid impermeable to prevent leakage.

The sub-structure 22 has been constructed so that the bulk bin 20 can be placed on footings narrower than the upper assembly 26, and in particular on conveyors typically 600 to 700 mm wide, whereas the bulk bin 20 suitably has an outer width of at least 1000 mm and even more suitably approximately 1165 mm by 1165 mm.

Figure 3:
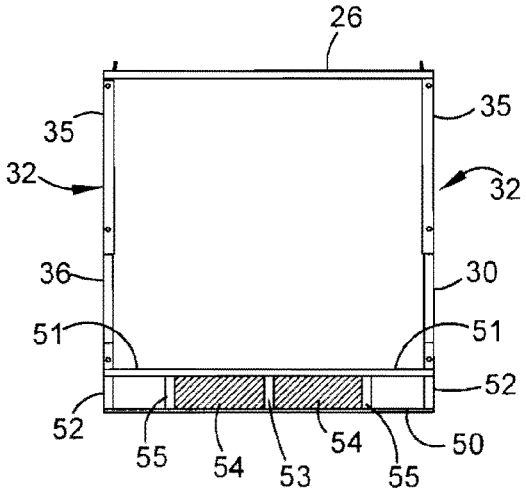
FIG. 3 is a left side view of the bulk bin shown in FIG. 1 including additional reinforcement for preventing forktines of a forklift entering the left side of the bulk bin.
Figure 4:
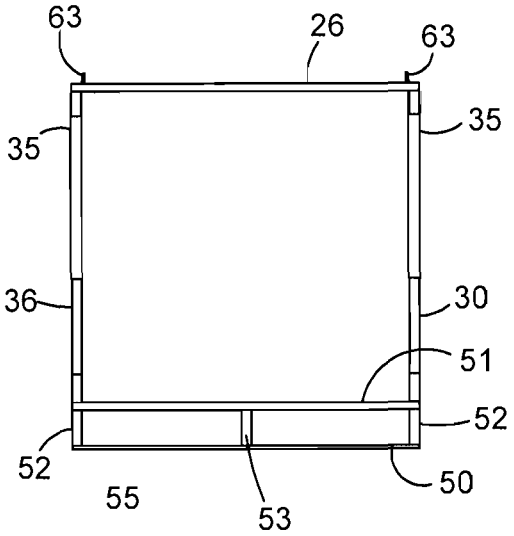
FIG. 4 is a right side view of the bulk bin shown in FIG. 1 showing the forktine entry side of the bulk bin which includes additional reinforcement for preventing forktines of a forklift entering the right hand side of the bulk bin.

The sub-structure 22 comprises: a rectangular (in this case, square) base frame 50 for sitting on the ground; a corresponding upper square frame 51; four corner sub-posts 52 extending upwardly from the base frame 50 at corners of the framework; four further centralised sub-posts 53 located halfway between each corner sub-post 52; inner support sub-posts 55 that are located approximately 300 mm to 400 mm either side of the centralised sub-posts 53; and barrier plates 54 between the centralised sub-posts 53 and the inner support sub-posts 55. The barrier plates 54 are intended to prevent the forktines 24 from being received from left and right hand sides of the sub-structure having the barrier plates 54. As can be seen in FIGS. 1 and 3, rather than barrier plates, openings for receiving forktines are provided at the front and rear sides of the sub-structure 22.

Figure 5:
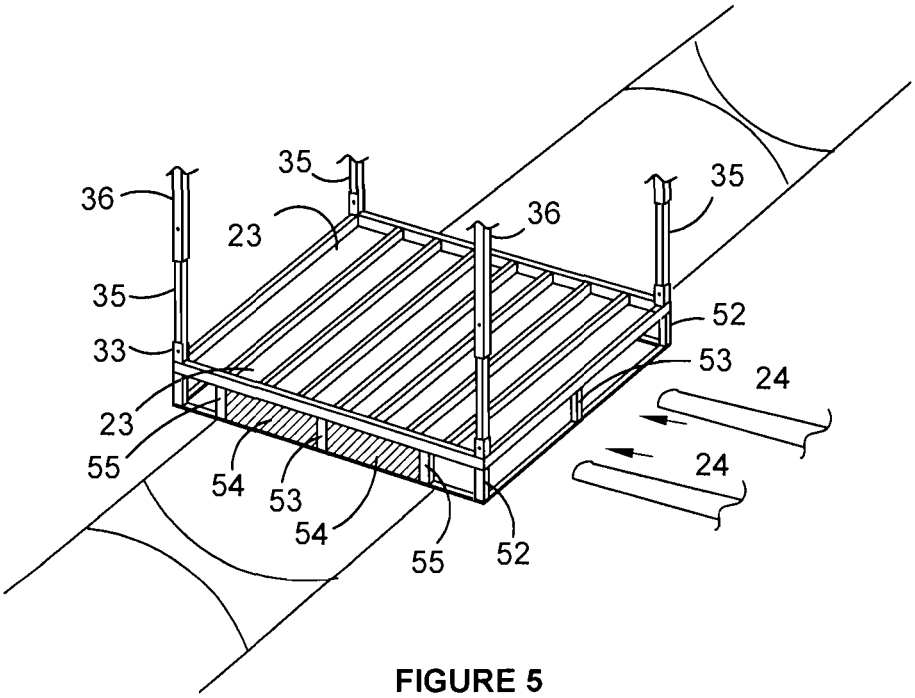
FIG. 5 is a schematic illustration of the bulk bin shown in FIG. 1 on a conveyor.

As can best be seen in FIG. 5, the inner sub-posts 55 are spaced at approximately the same width as the conveyer belt 60 which enables the inner sub-posts 55 to support the weight of the framework and a loaded bulk bag in a stable condition on a narrow footing than the corner posts 32 of the upper assembly 21.

Figure 10:
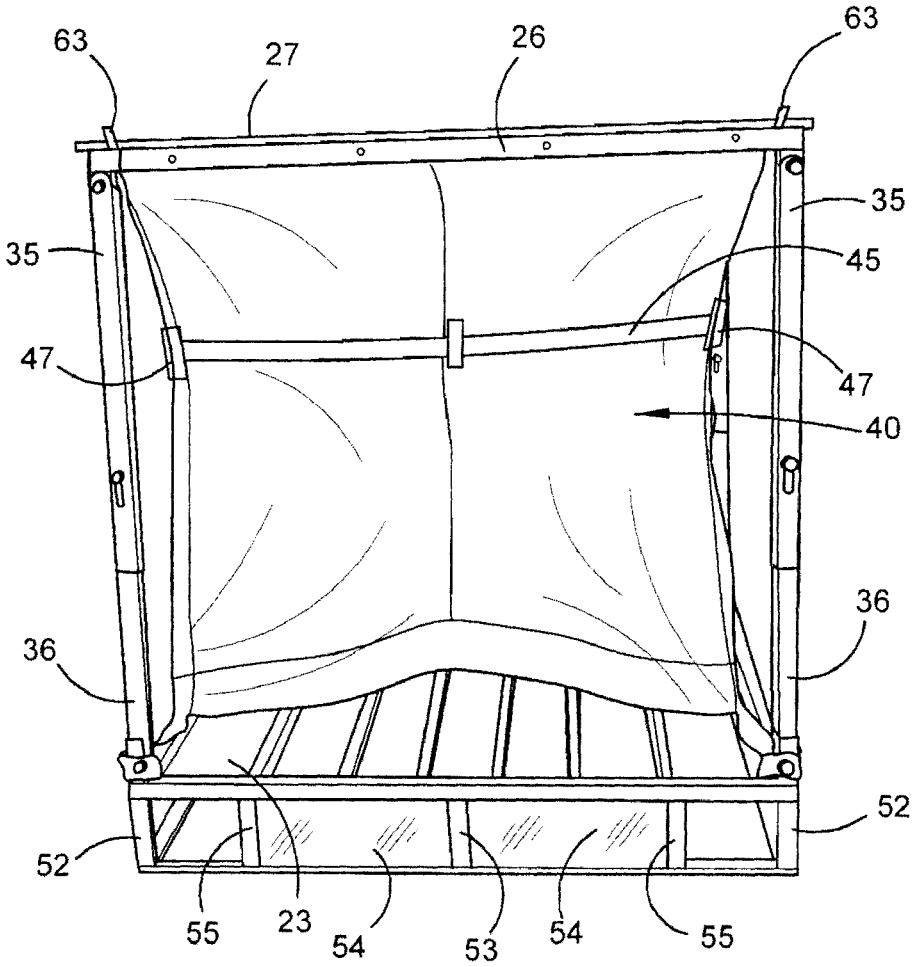
FIG. 10 is a schematic illustration of the bulk bin that is shown in FIG. 1 in an assembled orientation and fitted with liner bag of FIGS. 8*a* and 8*b;*

FIG. 10 illustrates the bulk bin in an assembled state and with an empty bag liner 40. Low tabs 61 extending from the lower corners of the bulk bag 40 and are attached to the corner posts 32 so that the bag 40 is held in essentially the preformed shape of the bag ready for filling.

The bulk bin 40 may be made of any suitable materials including plastics and composite materials. However, preferably, the framework is made from metallic materials such as aluminium or aluminium alloys and steel including food grade stainless steel. Each of the components of the framework may be made of the flat, tubular or even solid steel components and may be constructed using welding or suitable fasteners. Although not shown in detail in the Figures, suitably all welds are finished smooth and where possible, any gaps or holes in which material can be trapped are filled to reduce possible contamination risks.

Figure 12:
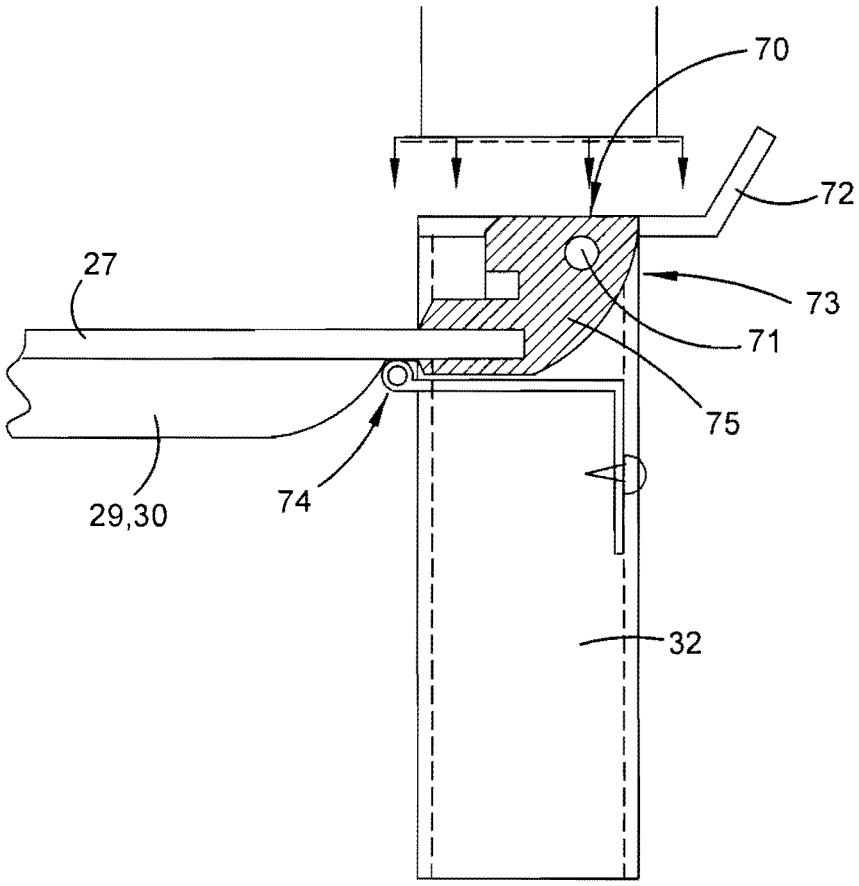
FIGS. 12 to 14 are schematic cross-sectional views of corner posts and pivot mounting assemblies according to an alternative embodiment and illustrate situations in which the lid is in a closed position, opened approximately 180 degrees, and opened approximately 270 degrees, respectively.
Figure 13:
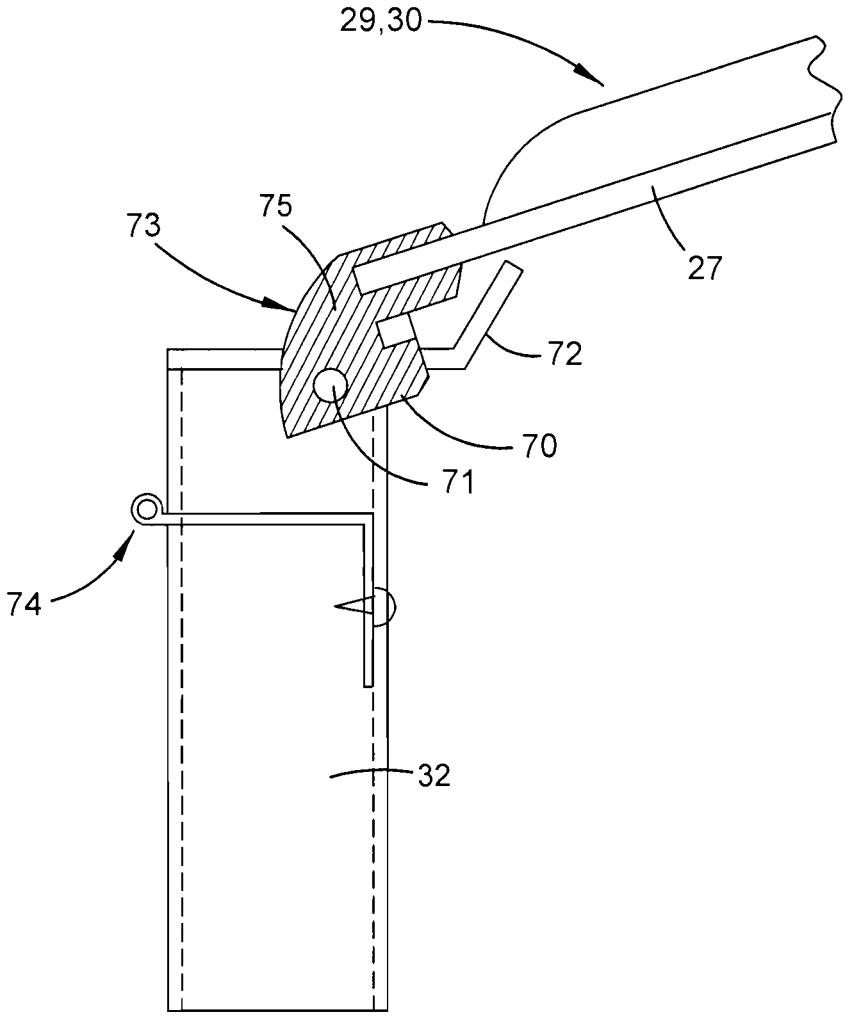
Figure 14:
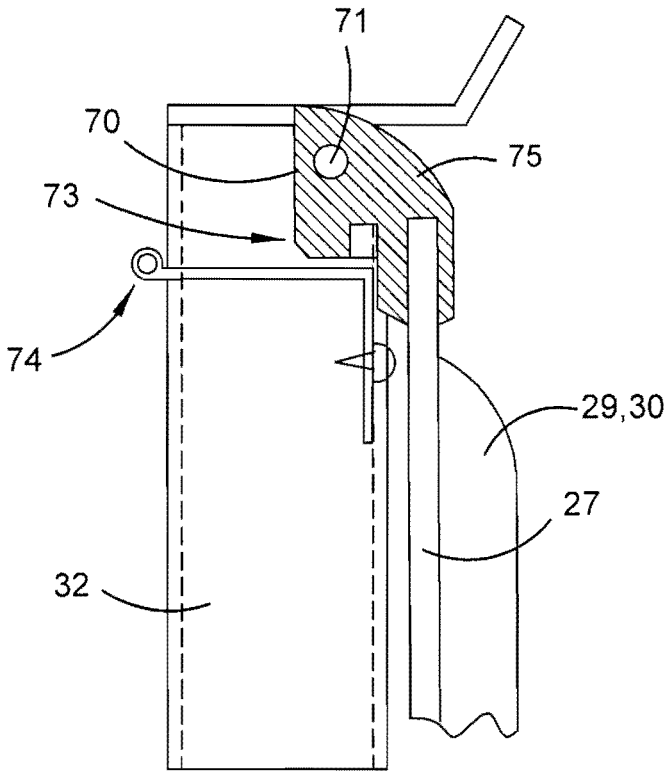

FIGS. 12 to 14 illustrate in detail another hinge assembly for mounting the lids 27 on opposite sides of the bin 20. The hinge assembly 73 includes a hinge body 75 defining a pivot axis 71 about which the hinge body 75 and one of the lids 27 that is 10 attached to the hinge body 75 pivots. As shown in FIG. 12, the hinge body 75 is configured with an engagement surface 70 that is located above the plan of the lid 27, and preferably above the pivot axis 71 when the lid 27 is located in a closed position. A rubberised seal 74 also extends about an opening of the upper assembly of the bin which contacts an inner face of the lid 27 when closed to inhibit the ingress of dust into the bin.

In the situation in which the bins 20 are stacked one on top of the other, a foot of the upper bin, which is shown in dashed lines in FIG. 12, can be located within guide flanges 72 of a lower bin and makes contact with the engagement surface 70 so as to prevent pivotal movement thereof and secure the lid 27 in a closed position. As can be seen in FIG. 12, when the engagement surface 70 aligns with the upper surface of the flange 72, the foot of the upper bin is supported on the corner posts 23, while the foot of the upper bin aligns against the engagement surface 70. The benefit if this arrangement is that the weight of the upper bin is predominantly supported by the corner posts 23, while in comparison, only a small portion of the weight of the upper bin need be supported by the engagement surfaces 70. However, the hinge body 75 is configured to prevent opening 25 of the lids 27 when the bins are stacked one on top of the other.

FIG. 13 illustrates the situation in which the lid 27 has been pivoted approximately 180 degrees from the closed position, and FIG. 14 illustrates the situation in which the lid 27 has been pivoted approximately 270 from the closed position. As can be seen in FIG. 14, when the lid 27 has been opened 270 degrees, the hinge body 75 is located below the 30 guide flanges 72 so that the bins can be stacked one on top of the other when opened 270 degrees.

It will be understood to persons skilled in the art of the invention that many modifications may be made to the embodiments described above without departing from the spirit and scope of the invention.

The invention claimed is:

1. A bulk bin including:

a sub-structure that is configured to receive forktines of lifting machinery for moving the bulk bin;

a collapsible upper assembly that is supported on the sub-structure, and a bag attached to the upper assembly with an entrance of the bag in an upwardly facing orientation for filling, and the upper assembly has a plurality of collapsible posts, each post having at least two members that are interconnected in a way that allows relative movement between the members, and in turn allows the upper assembly to be moved between, i) a collapsed orientation to facilitate transportation of the bulk bin in a space saving manner while the bag remains attached to the upper assembly, and ii) an erected orientation for loading the bag; and a pair of lids pivotally mounted to the upper assembly that are moveable to open and close the entrance to the bag, and the lids have a stiffness that allows the lids to be seated against the upper assembly when closed and span self supportingly over the entrance of the bag;

wherein the upper assembly includes a support surface on which another bulk bin can be seated when an upper bin is stacked on top of a lower bin, and the support surface and upper assembly of the lower bulk bin can support the weight of the upper bulk bin, and the lids of the lower bulk bin can be prevented from opening by the lids engaging the upper bin.

2. The bulk bin according to claim 1, wherein the support surface of the upper assembly includes guide flanges that can guide the upper bin into a seated position.

3. The bulk bin according to claim 1, wherein the lids are configured so that orienting the bin to selected positions can cause the lid to open under gravity.

4. The bulk bin according to claim 1, wherein the lids are configured so that orienting the bin into a position in which the lid faces downwardly can cause the lid to open under gravity.

5. The bulk bin according to claim 1, wherein the lids pivoted through at least 90 degrees to open and close the entrance of the liner bag.

6. The bulk bin according to claim 1, wherein the lids have side edges that overlap when closed.

7. The bulk bin according to claim 6, wherein the lids have oppositely disposed pivot mountings and the lids pivot inwardly toward each other so that outer side edges of the lids overlap when closed.

8. The bulk bin according to claim 6, wherein each lid extends across half of the width of the bin and are opened by being pivoted so that the lids can be located downwardly adjacent to the outer sides of the bin such that a number of the bins can be placed side-by-side at a spacing of at least half the width of the bins, and the lids can be opened and closed.

9. The bulk bin according to claim 1, wherein the lids have an engagement surface that pivots about the pivot mounting of the lids, and the engagement surface faces upwardly when the lids are located in a closed position such that when the bins are stacked one on top of the other, the engagement surface of the lower bin can be engaged by the upper bin so as to hold the lids of the lower bin in a closed position.

10. The bulk bin according to claim 9, wherein the bin includes a hinge mechanism and the lids are attached thereto, and the hinge mechanism defines a pivot axis and includes the engagement surface which is disposed above a plane of the lids when closed.

11. The bulk bin according to claim 9, wherein the engagement surface aligns with the support surface of the upper assembly when the lids are in a closed position, such that a foot of the upper bin can engage the engagement surface to secure the lids in the closed position.

12. The bulk bin according to claim 1, wherein the bulk bin includes a retainer that releasably secures the lids in either the opened position and/or the closed position.

13. The bulk bin according to claim 1 wherein the lids have:

i) an outer peripheral portion that can be seated on an abutment surface of the upper assembly; and ii) an inner protruding portion that protrudes in a direction lateral from the outer peripheral portion so that when the lids is located in a closed position the inner protruding portion provides a barrier to contaminants passing between the outer peripheral portion and the abutment surface.

14. The bulk bin according to claim 13, wherein the inner protruding portion is orthogonal to the peripheral portion.

15. The bulk bin according to claim 1. wherein the lids comprise a rigid plastic mold construction.

16. The bulk bin according to claim 1, wherein the bin includes a deformable medium that forms a seal between the lids and the upper assembly, when the lids are closed so as to hinder the ingress of contaminants into the bag liner.

17. The bulk bin according to claim 1, wherein the bulk bin is characterised as including a liner bag having a flexible bottom wall, a flexible side wall that defines the upper entrance of the bag and the side wall folds when the upper assembly is moved between erect and collapsed orientations.

18. The bulk bin according to claim 17, wherein the side wall of the liner bag is elasticised about at least part of the perimeter thereof so as to draw the side wall inwardly when the upper assembly is collapsed and/or the liner bag is unload.

19. The bulk bin according to claim 17, wherein the side wall of the bag liner is elasticised over at least part of either i) the height of the liner bag or ii) elasticised over at least part of the bottom wall of the liner bag that can draw lower sections of the bag liner inwardly.

20. The bulk bin according to claim 17, wherein the liner bag includes elastic elements attached to the linear bag about either: i) the perimeter of the liner bag; or ii) the bottom wall of the liner bag.

21. The bulk bin according to claim 17, wherein the upper assembly of the bin includes a top frame and the entrance of the bag may be attached to the top frame.

22. The bulk bin according to claim 21, wherein the side wall of the bag, defining the entrance to the bag, is located on an inside of inwardly facing surfaces of the top frame and the entrance of the bag is equal to, or smaller than, an inside perimeter of the top frame.

23. The bulk bag according to claim 21,wherein the bag is folded outwardly and attached to either upper and/or outwardly facing surfaces of the top frame.

24. The bulk bag according to claim 17,wherein the bag has a constant peripheral measurement or a reducing peripheral measurement in a direction away from the entrance such that the side wall of the bag can provide a continuous and unobstructed surface to the entrance of the bag.

25. The bulk bag according to claim 1, where the entrance of the bag is completely uncovered when the lid is opened.

26. The bulk bin according to claim 1, wherein the sub-structure includes forktine cavities for receiving the forktines of a forklift truck, and the cavities having an upper partition to prevent the bag liner entering into the cavities.

27. The bulk bin according to claim 1, wherein the collapsible posts have pivotally interconnected linkage members, the linkage members fold inwardly over the sub-structure to move the upper assembly and lid toward the sub-structure when in the collapsed position.

28. The bulk bin according to claim 1, wherein the sub-structure includes:

an upper quadrangular frame on which lower supports are mounted;

a lower quadrangular frame for sitting on the ground;

four corner sub-posts that interconnect the upper and lower quadrangular frames; and intermediate sub-supports disposed intermediate of the corner sub-posts and interconnecting the upper and lower quadrangular frames.

29. The bulk bin according to claim 28, wherein the intermediate sub-posts are spaced apart in the range of 600 to 800 mm along the quadrangular frames.

* * * * *